United States Patent [19]

Dreyer

[11] 3,964,618

[45] June 22, 1976

[54] PALLET DEVICES AND METHOD

[76] Inventor: John E. Dreyer, R.R. 1, Sugar Grove, Ill. 60554

[22] Filed: Dec. 12, 1974

[21] Appl. No.: 531,881

[52] U.S. Cl. ..... 214/10.5 R; 108/56; 214/152

[51] Int. Cl.[2] ..... B65G 1/14

[58] Field of Search ..... 214/10.5 R, 152; 108/56 R

[56] References Cited

UNITED STATES PATENTS

| | | | |
|---|---|---|---|
| 3,022,906 | 2/1962 | Sandusky | 214/10.5 R |
| 3,026,078 | 3/1962 | Simkins | 108/56 |
| 3,043,450 | 7/1962 | Caprin | 214/10.5 R |

FOREIGN PATENTS OR APPLICATIONS

| | | | |
|---|---|---|---|
| 133,115 | 9/1951 | Sweden | 214/152 |

*Primary Examiner*—Frank E. Werner
*Assistant Examiner*—George F. Abraham
*Attorney, Agent, or Firm*—Hill, Gross, Simpson, Van Santen, Steadman, Chiara & Simpson

[57] ABSTRACT

A pallet device formed from a blank of sheet-form, semi-rigid material is arranged to be loaded with the aid of a form jig having a base and upstanding rigid form flanges, whereby a base panel of the device is received on the jig base between the form flanges, respective riser panels along opposite sides of the base panel are held upright by the form flanges, fork lift shoulder panels extending from the tops of the riser panels into overhanging relation outwardly from the form flanges. Respective retainer panels wider than the shoulder panels are arranged to overlie each of the shoulder panels and to extend inwardly into overhanging relation to the base panel and into engagement with objects loaded onto the base panel between the riser panels. The retainer panels are then interlocked with the objects by placing other objects in loading relation on top of the retainer panels. The retainer panels may be hingedly attached to the shoulder panels or separately formed and then attached to the shoulder panels.

11 Claims, 13 Drawing Figures

PALLET DEVICES AND METHOD

This invention relates to pallet devices and is more particularly concerned with such devices that may be formed from blanks of sheet-form, semi-rigid material, such as boxboard, and which may be disposable or reusable.

Although pallets of the general kind contemplated herein have been proposed heretofore as exemplified in prior U.S. Pat. No. 3,043,450, the struck-out tongue-shaped tabs relied upon therein to maintain the pallet in association with the load present several disadvantages, not the least of which is that the tongues interfere with loading of the pallet. Further, the area of surface presented by the small punched-out tongue tab does not afford enough friction to hold the pallet together for loaded manipulation, especially where it may fall across the joint of abutting packages or other objects on the pallet. A major disadvantage arises because the tongue tab is struck from the side wall material and therefore weakens the side walls.

An important object of the present invention is to overcome the foregoing and other advantages, inefficiencies, shortcomings and problems and to attain important improvements and advantages by the provision of a new pallet device and method of loading the same.

Another object of the invention is to provide a new and improved pallet device formed from a piece of sheet-form, semi-rigid material and which is especially adapted for efficient loading in a simple form jig.

A further object of the invention is to provide a new and improved pallet device formed from sheet-form, semi-rigid material and having novel load-engageable locking means.

Still another object of the invention is to provide a new and improved disposable pallet device which can be made from low cost material, is simple to load, is efficient in use, and where desired, may be reused.

According to features of the invention, a pallet device is adapted to be formed from sheet-form, semi-rigid material and provides a base panel adapted to be placed for loading into a form jig having a horizontal base and upstanding spaced apart rigid form flanges, there being respective riser panels connected along opposite sides of the base panel and adapted to be held upright by the form flanges, each of the riser panels having connected to its edge which is remote from the base panel, a fork lift shoulder panel adapted to project laterally outwardly from the associated form flange in the jigged relation of the device for engagement by lifting fork arms. A respective retainer panel wider than the shoulder panels is arranged to overlie each of the shoulder panels and to extend inwardly into overlying relation to the base panel and into engagement with objects loaded onto the base panel between the riser panels, and then interlocked with the objects by placing other objects in loading relation on top of the retainer panels. The retainer panels may be hingedly attached to the shoulder panel or may be separately formed and then suitably attached to the shoulder panels. The device is of such economical construction that it may be disposed of after use, although it may be reused if desired.

Other objects, features and advantages of the invention will be readily apparent from the following description of certain preferred embodiments thereof, taken in conjunction with the accompanying drawings, although variations and modifications may be effected without departing from the spirit and scope of the novel concepts embodied in the disclosure, and in which.

Figure 1:
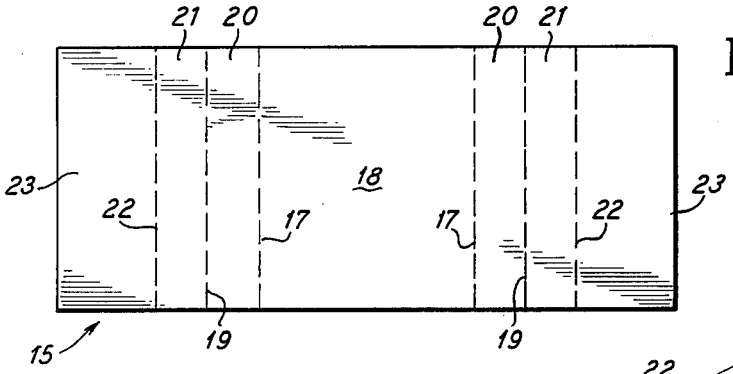
FIG. 1 is a plan view of a blank for a pallet device according to the present invention.

According to the present invention, pallet devices are formed up from blanks of sheet-form, semi-rigid material, and more particularly, boxboard, such as suitable corrugated board, chip board which may or may not be treated or coated for moisture-proofing or wear-resistance or stiffening such as by plastic coating. Further, making of the blanks involves only simple shearing of pieces into desired size flat blanks and scoring or creasing to delineate desired foldable panels. By way of a preferred example, reference is invited to FIG. 1 showing a blank 15 of elongated rectangular form scored or creased along parallel fold lines 17 across its narrow dimension to provide a base panel 18. Spaced equidistantly outwardly from the fold lines 17 are respective similar fold lines 19 delineating respective riser panels 20 between the fold lines 17 and 19 and fork lift panels 21 between the fold lines 19 and spaced parallel fold lines 22. Outwardly from the panels 21 and hingedly connected thereto at the fold lines 22 are respective retainer panels 23 which are substantially wider than the shoulder panels 21, such as on the order of twice as wide. As thus formed, the blank 15 can be stock piled with a large number of similar blanks in flat condition and can be shipped with utmost economy from manufacturing plant to point of use.

Figure 2:
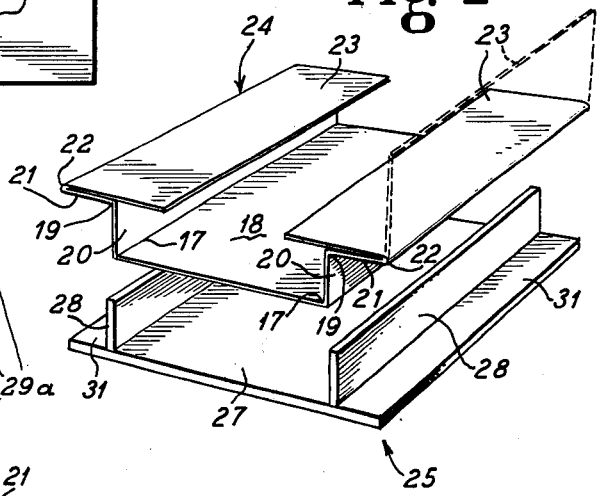
FIG. 2 is a perspective view of a pallet device formed up from the blank of FIG. 1 and showing the same illustratively with a form jig especially adapted to facilitate loading the device.

Setting up of the blank 15 into a pallet device 24 (FIGS. 2 and 3) can be effected easily and quickly and is preferably effected with the aid of a form jig 25. This comprises placing the base panel 18 of the device into loading position on a horizontal base 27 of the form jig 25 between upstanding spaced apart rigid form flanges 28 which are spaced for receiving the base panel 18 between the fold lines 17, and using the form flanges 28 to hold the riser panels 20 upright. For this purpose, the flanges 28 are of substantially the same width as the panels 20, and the length of the flanges 28 as well as the corresponding dimension of the jig base 27 is desirably substantially the same as the length of the panels 20 and the base panel 18 between its opposite free edges. Placing of the device in the form jig 25 can thus be quickly effected by simply aligning the base panel 18 over the jig base 27 and pressing down on the base panel 18 which will cause the riser panels 20 to be bent up along the fold lines 17 into upright position by means of the jig flanges 28 which then hold the panels 20 in upright position. Locating of the fork lift shoulder panels 21 in overhanging laterally outwardly projecting relation to the associated form flanges 28 is quickly effected by bending the shoulder panels along the fold lines 19. The respective retainer panels 23 may, until partial loading of the pallet has been completed, be left in outwardly projecting relation and in any event, in a non-interfering clearance position relative to the base panel 18 so that objects 29, such as packages, cartons, boxes, containers or the like can be freely deposited on the base panel 18 between the upright riser panels 20 without any interference from the retainer panels 23. It will be appreciated, of course, that the dimensions of the base panel 18 and the riser panels 20 should be reaonably correlated to the dimensions of the objects 29 to receive a full complement of closely packed objects over the area of the base panel and to a height in a plane with the laterally projecting shoulder panels 21.

Figure 3:
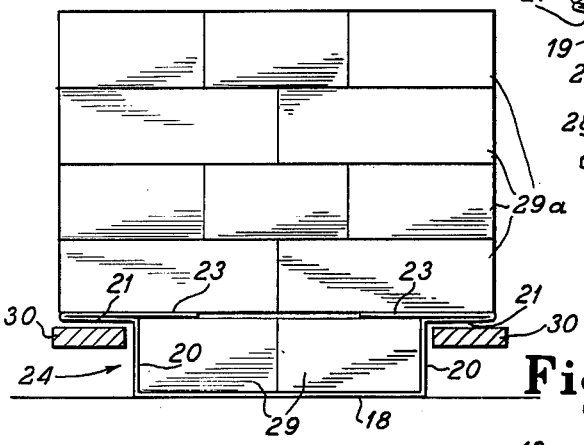
FIG. 3 is an end elevational view of the pallet device showing the same loaded with objects to be carried thereby.

After the objects 29 have been loaded onto the base panel 18, the respective retainer panels 23, which are hingedly connected to the shoulder panels 21 at the fold lines 22, are swung from their outward non-interfering clearance positions relative to the base panel 18 into overlying engagement with the objects which were deposited on the base panel. This action is schematically demonstrated in FIG. 2 which in dash outline shows one of the panels 23 partially folded up to a vertical position from its original planar relation to the associated panel 21, and with both of the panels 23 shown in full outline as in lapped relation over the shoulder panels 21 and projecting into overhanging relation to the base panel 18. In FIG. 3, it will be seen that the inwardly projecting overhanging portions of the retainer panels 23 are in overlying engagement with the objects 29. Thereafter, and desirably while the pallet device 24 is still in the jig 25, interlocking of the retainer panels 23 with the objects 29 is effected by placing other objects 29a in loading relation on top of the retainer panels 23, substantially as shown. Not only should the objects 29a overlie those portions of the panels 23 which overlie the objects 29, but also those portions of the panels 23 which overlie the shoulder panels 21, and with all of the objects 29a to whatever height they may be stacked on the pallet device in abutting relation in each layer entirely across the stack preferably in both horizontal directions. This provides a solid palletized load which can be conveniently and efficiently handled by means of a fork lift truck with its fork tines or arms 30 engaging the load under and through the shoulder panels 21. Through this arrangement the lift fork arm lifting force is applied directly through the mutually reinforcing laminar panels 21 and 23 to objects lying on the retainer panels 23. It will be observed that the form jig 25 is provided with means to facilitate stripping the same from the pallet 24, conveniently comprising lateral base flanges 31 along the outer sides of the form flanges 28 and providing hold-downs by which the jig can be held down until the fork lift arms 30 have raised the loaded pallet device 24 from the jig.

Figure 4:
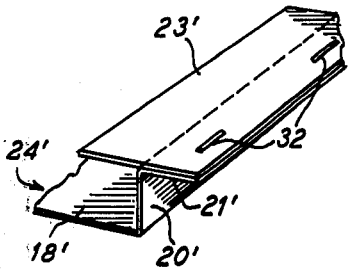
FIG. 4 is a fragmentary perspective view of a modified construction of the pallet device.

If for any reason it may be desired to provide the retainer panels 23 separate and apart from the remainder of the pallet device blank, instead of integrally hingedly connected in one piece with the shoulder panels 21, the arrangement shown in FIG. 4 may be used. This comprises a pallet device 24' having a base panel 27', riser panels 20' and shoulder panels 21' all foldably connected and corresponding to and functioning the same as the counterpart panels of the pallet device 24. In this instance, however, the retainer panels 23' (only one being shown and it will be understood that there will be a pair of such panels similarly as in the pallet device 24) are separately formed and arranged to be applied in overlying relation to the respective shoulder panels 21' and to extend inwardly into overhanging relation to the base panel 27' and into engagement with objects loaded onto the base panel between the riser panels 20', the same as described in connection with FIG. 3 to be interlocked therewith by placing other objects in loading relation on top of the retainer panels. Any suitable means may be employed to attach the panels 23' to their underlying shoulder panels 21', such as suitable adhesive or staples 32, as shown. Through this arrangement, the panels 23' may be attached to the panels 21' while the blanks is in a flat condition, or the panels 23' may be attached to the panels 21' after objects have been loaded onto the base area of the pallet device. Where the panels 23' are pre-attached to the panels 21', the overhanging, inwardly extending portions of the panels 23' may be positioned in clearance relation to the base panel 27' for loading by swinging the shoulder panels 21' downwardly toward the outer sides of the associated riser panels 20' whereby the panels 23' will project upwardly and leave the area over the base panel 27' free to receive a load thereon. Thereafter, the panels 23' can be readily swung over into the overhanging relation to the base panel 27' and into engagement with the load on the base panel, for interlocking with such objects by placing of other objects in loading relation on top of the retainer panels 23'.

Figure 5:
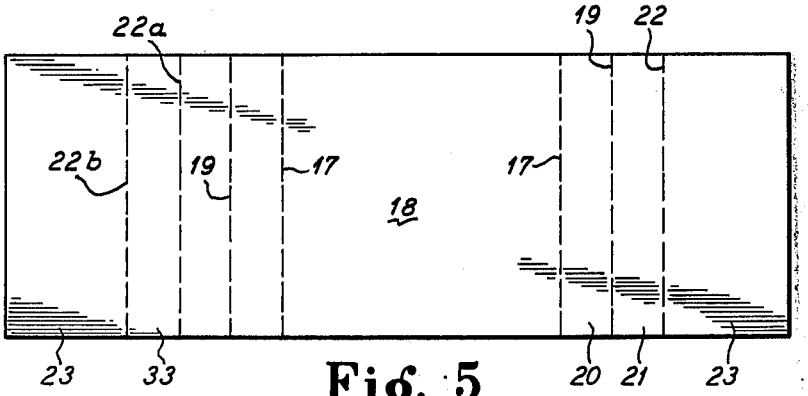
FIG. 5 is a plan view of a blank for a slightly modified form of the pallet device.
Figure 6:
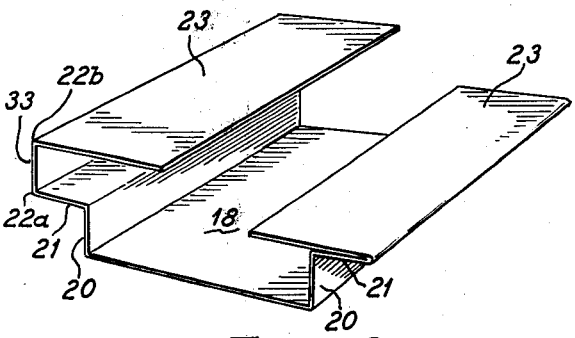
FIG. 6 is a perspective view of the pallet device formed up from the blank of FIG. 5.
Figure 7:
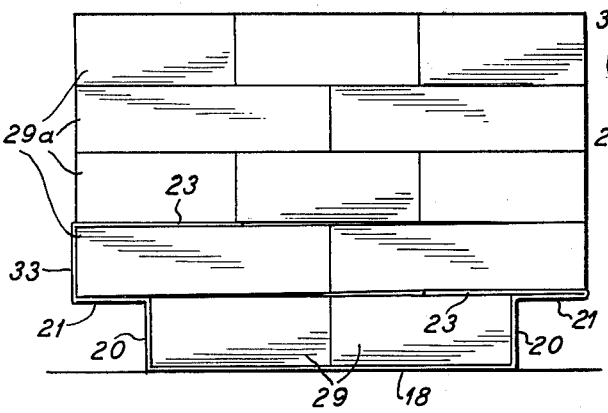
FIG. 7 is an end elevational view of the device of FIG. 6 in loaded condition.

Increased load-retaining stability for the pallet device may be attained by having at least one of the retainer panels 23 arranged to be fully engageable throughout its length and width with object to be carried by the pallet device. For example, as shown in FIGS. 5, 6 and 7, one of the retainer panels 23 may be attached to the associated shoulder panel 21 by means of a spacer panel 33 joined to the associated shoulder panel 21 by means of a fold line **22*a* and joined to the associated panel 23 by means of a fold line 22*b*. In width, the spacer panel 33 is equal to at least one object height so as to receive at least one palletized layer of the objects 29*a* between the underlying shoulder panel 21 and the upwardly spaced retainer panel 23, substantially as shown in FIG. 7. Additional of the objects 29*a* are then stacked on top of the thus arranged retainer panel 23, effecting interlock throughout the area of the panel between and with the underlying and superposed objects 29*a*, with the underlying objects 29*a* engaging the underlying shoulder panel 21. All other panels of the pallet device may be substantially the same as the corresponding panels of the device as described in connection with FIGs. 1–3, although there may be some variations in actual dimensions of the panels to accommodate objects of different basic dimensions. For example, it may be noted that the panels 18 and 23 in FIGs. 5–7 are slightly larger in at least their width, considered in the longitudinal direction of the blank, than the panels 18 and 23 in FIGS. 1–3.** The relationship and function of the panels, however, remain the same.

Figure 8:
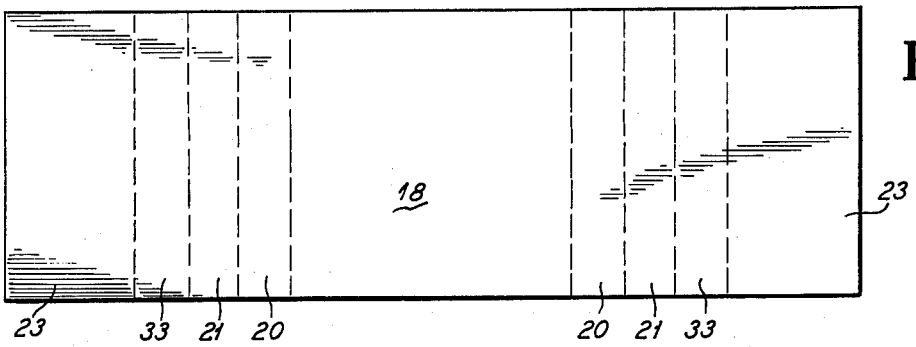
FIG. 8 is a plan view of a blank showing another modification.
Figure 9:
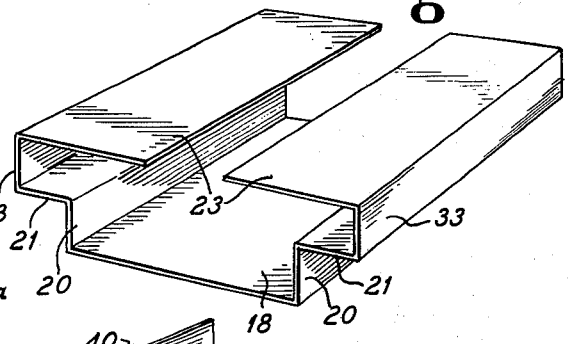
FIG. 9 is a perspective view of a pallet device formed up from the blank of FIG. 8.
Figure 10:
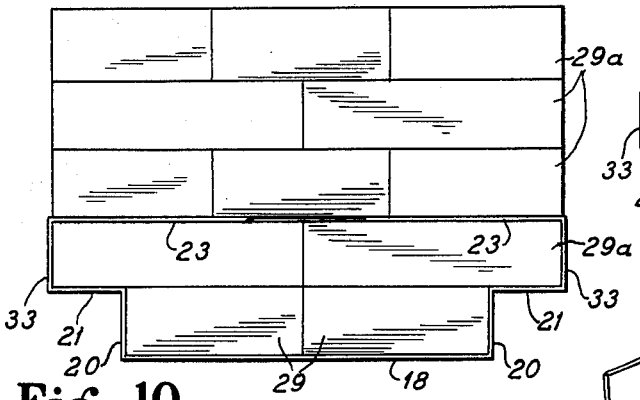
FIG. 10 is an end elevational view of the pallet device of FIG. 9 in loaded condition.

In the modification of FIGS. 8, 9 and 10, stabilization of the loaded pallet is further improved by providing spacer panels 33 for both of the retainer panels 23 instead of only one such spacer panel 33 as in FIGs. 5–7. Thereby, as best seen in FIG. 10, both sides of the loaded pallet device have the retainer panel 23 overlying in engagement with and clamped against the first tier of the objects 29*a*, and which objects also rest on the shoulder flanges 21, with the second tier of the objects 29*a* clamping the panels 23 in retaining relation against the underlying tier of the objects 29*a*, and encompassing the whole area of the panels 23. All of the other panels, 18 and 20, of the pallet device are of substantially the same structure and function in the same manner as described for the corresponding panels of the pallet device 24 in FIGs. 1–3.

Figure 12:
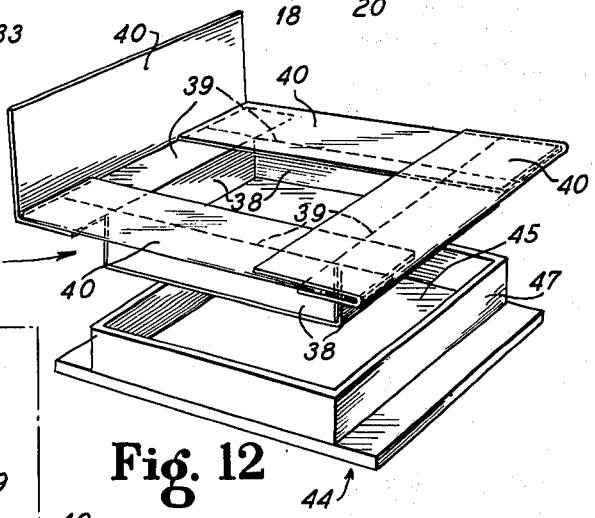
FIG. 12 is a perspective view showing the pallet device formed up from the blank of FIG. 11.
Figure 11:
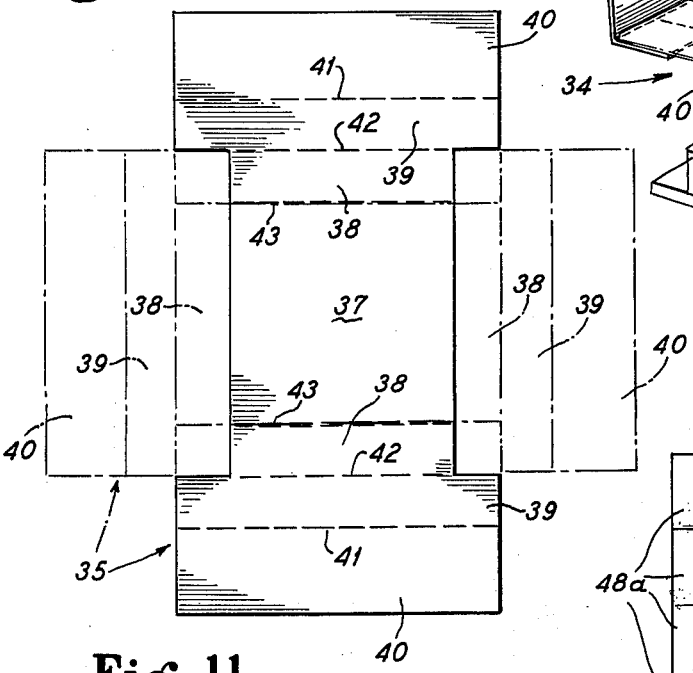
FIG. 11 is a plan view of still another modified pallet device blank.
Figure 13:
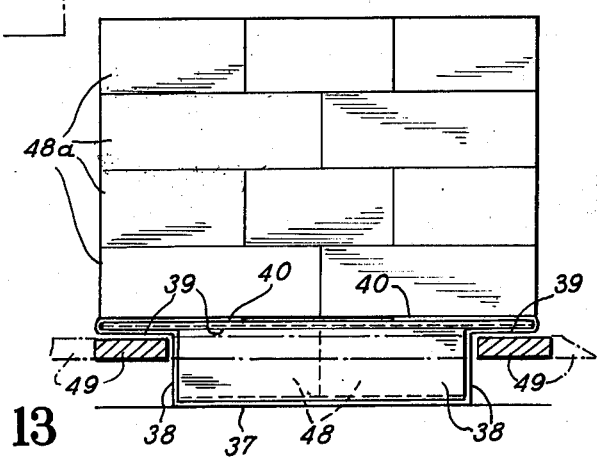
FIG. 13 is an end elevational view of the pallet device of FIGS. 11 and 12 in loaded condition.

Up to this point, the pallet devices have been what may be termed as two-way entry forms, in that they provide only for engagement within the reentrant, generally rabbet groove formations under the overhanging shoulder flanges 21 of the fork lift arms 30 along two opposite sides of the loaded pallet. In FIGS. 11–13, a pallet 34 is depicted which provides for what may be termed as four-way entry, in that the device is provided with fork lift facility along each of four sides, any opposite two of which can be engaged by the fork lift arms. To this end, the pallet is made up of two blanks 35, each of which comprises a base panel 37, opposite side riser panels 38 to which are connected fork lift shoulder panels 39 which have, in turn, retainer panels 40 connected thereto. A hinge fold line 41 is provided at juncture of each of the panels 40 with its associated panel 39, fold lines 42 are provided at juncture of the panels 39 with the panels 38, and juncture fold lines 43 are provided between the panels 38 and the base panel 37.

In setting up the pallet device 34, a pair of the blanks 35 is internested in right-angular crosswise relation, with the base panels 37 in superimposed laminar matching relation to one another. Then, by pressing the internested base panels 37 into a form jig 44 onto a forming base 45 provided thereby within the quadrangular confines of upstanding spaced apart rigid form flange means 47, the riser panels 38 are moved into upright position. Then the shoulder panels 39 and the retainer panels 40 are moved into laterally overhanging outward projecting relation to the form flange means 47 and the assembly of base flanges 37 loaded with objects 48 to be carried by the pallet device. Then the retainer panels 40 are folded into overlapping relation to one another and onto the loaded objects 48 and extend into substantial overhanging relation to the base panels 37 by virtue of being on the order of twice as wide as the shoulder panels 39 over which the panels 40 extend in laminar relation. Then as many tiers of objects 48a are placed in loading relation over and onto the retainer panels 40, interlocking them thoroughly in the palletized stack of objects which are preferably arranged for interlocking purposes in an alternately staggered relation substantially in the manner of courses of laid bricks, as desired.

For increased stability and strength in the fork lift shoulder arrangement of the pallet 34, the shoulder panels 39 and the retainer panels 40 are desirably longer to an equal extent beyond opposite ends of the riser panels 38 so as to effect overlapping engagement of the shoulder panels 39 of the respective blanks at the four corners of the pallet device, and also overlapping interengagement of the retainer panels 40 at the four corners of the pallet device. This provides unusual reinforcement and strength at the corners to withstand abusive contact in service, and assists in stabilizing and strengthening the shoulder structure of the pallet device for lift truck manipulation. As represented in FIG. 13, lift truck fork arms 49 can engage in one direction under opposite ones of the shoulders 39 as shown in full outline, and can engage in the crosswide direction under the remaining shoulders 39 if preferred, as indicated in dot-dash outline of the fork arms 49. This improves the versatility and handling of the pallet device by means of a fork lift truck.

From the foregoing it will be appreciated that the present invention provides pallet devices that are especially suitable for use with uniform rectangular or square cartons or containers such, for example, as cases of canned goods, cartons of bottles, and the like which can be uniformly stacked within and upon the respective pallet devices. By placing major weight of the load above and upon the retainer panels, the pallet is held against pulling apart. By the alternate, brick-course stacking of the load objects, and with the pallet device conforming skinlike with the contained portion of the load, the pallet device is held rigid as the weight of the major load is stacked thereon. Contributing largely to this new and advantageous result, is the large stabilizing, anchoring areas of the retainer panels which are provided to provide maximum usable area by extending entirely along and coextensive with the shoulder panels and being of such width as to be gripped between large areas of the tiers of objects between which the retainer panels are sandwiched in the loaded condition.

When fork lifting the loaded pallet device, it is primarily the weight of the load which is supported by the forks. The pallet device serves principally to hold the shape of the load and to facilitate entry and exit of the fork arms under the load. Another advantage of the pallet devices according to the present invention is that palletized loads can be safely and efficiently stacked upon the other for quick fork lift stacking and removal because of the efficient shape retention qualities of the pallet devices and because they provide only smooth unobstructed base panel areas underneath for resting flat upon the tops of the objects in the uppermost tier of each subjacent palletized load.

In addition, the pallet devices can be stock piled and shipped in the most economical manner, both as to space and handling, because they can be shipped flat and are lightweight. By providing the pallet blanks with preformed fold line scorings or creasing, the various panels of the pallet devices are readily conformed to the exact shape of the objects to be stacked thereon. Since the pallet devices are produced from relatively inexpensive material, especially as compared to wooden, steel or similar type pallets, the pallet devices of the present invention can be discarded without economic penalty, or they can be recycled in the manner of other paper products, and where the usage is not too severe, the pallet devices can be salvaged and reused.

It will be understood that variations and modifications may be effected without departing from the spirit and scope of the novel concepts of this invention.

I claim as my invention:

1. A pallet device formed from sheet-form semi-rigid material, comprising:

a base panel adapted to be placed for loading into a form jig having a horizontal base and upstanding spaced apart rigid form flange means;

respective riser panels connected along opposite sides of the base panel and adapted to be held upright by said form flange means;

a fork lift shoulder panel connected to the edge of each of said riser panels which is remote from said base panel, and adapted to project in overhanging relation laterally outwardly from the associated form flange in the jigged relation of the device for engagement by lift fork arms;

respective retainer panels wider than the shoulder panels arranged to overlie each of the shoulder panels and to extend inwardly into overhanging relation to the base panel and to engage with objects loaded onto said base panel between said riser panels, and the retainer panels then being interlocked with said objects by placing other objects in loading relation on top of the retainer panels;

means attaching said retainer panels to said shoulder panels;

and at least one of said retainer panels lying in mutually reinforcing laminar relation over its underlying shoulder panel whereby lift fork arm lifting force is applied directly through the laminar panels to objects lying on said one retainer panel.

2. A pallet device according to claim 1, wherein said means for attaching said retainer panels to said shoulder panels include a fold joint between said one retainer panel and its underlying shoulder panel, and a generally vertical spacer panel connecting the other of said retainer panels to its underlying shoulder panel.

3. A pallet device according to claim 1, wherein said retainer panels are both hingedly connected to the other edges of the underlying edges of said shoulder panels and are adapted to be in clearance relation relative to the base panel to facilitate placing of objects on the base panel, whereafter the retainer panels can be swung inwardly into overlying engagement with the underlying shoulder panels and with the objects on the base panel and then interlocked therewith by the placement of the other objects in loading relation on top of the retainer panels.

4. A pallet device according to claim 1, wherein said retainer panels are formed separately and are in laminar relation to said shoulder panels by said attaching means.

5. A method of loading a pallet device formed from sheet-form semi-rigid material, comprising:

placing a base panel of the device into loading position on a horizontal base of a form jig between upstanding spaced apart rigid form flange means;

using said form flange means to hold in upright position respective riser panels connected along opposite sides to the base panel;

locating in overhanging laterally outwardly projecting relation to the associated form flange means respective fork lift shoulder panels connected to the edges of the riser panels which are remote from the base panel;

loading objects on said base panel between the upright riser panels;

placing wider retainer panels into position over the shoulder panels and to extend therefrom into overhanging relation to the base panel and into engagement with the objects loaded onto said base panel, at least one of the retainer panels being placed in laminar mutually reinforcing relation on the underlying shoulder panel; and interlocking said retainer panels with said objects by placing other objects in loading relation on top of the retainer panels.

6. A method according to claim 5, wherein attachment of said retainer panels to said shoulder panels comprises providing the retainer panels as separate panels and physically attaching the retainer panels in laminar relation in to the shoulder panels.

7. A method according to claim 5, comprising mounting of two of the pallet devices onto the base of the form jig with the base panels of the two pallet devices in laminar relation, within the form flange means holding the riser panels upright to provide a rectangular retaining enclosure, and after the objects bore been loaded onto the base panels placing the retainer panels of both of the devices into overlying relation to the objects and overlapping the ends of the retainer panels in reinforcing relation to the four corners of the assembly, with the shoulder panels providing four fork lift arm engageable areas about the perimeter of the assembly.

8. A pallet device formed up from a pair of elongated blanks each of which has a base panel, riser panels at opposite ends of the base panel, shoulder panels extending from the riser panels, and retainer panels on the shoulder panels;

the blanks being placed in right angularly crossing relation with the base panels in laminar superposed relation;

said riser panels extending upwardly and defining a four-sided enclosure for objects to be carried by the device;

said shoulder panels projecting laterally from the tops of the riser panels to provide overhanging fork lift shoulders along said four sides of the enclosure; and said retainer panels being wider than the shoulder panels and arranged to overlie the shoulder panels and to extend inwardly into overhanging relation to the base panels and to engage with objects loaded onto the base panels between the riser panels and to be interlocked with such objects by placing of other objects in loading relation on top of the retainer panels.

9. A pallet device according to claim 8, wherein said shoulder panels are longer than the riser panels and have end portions projecting beyond the riser panels, and said end portions of the shoulder panels being in overlapping reinforcing relation at the four corners of the pallet device.

10. A pallet device according to claim 9, wherein said retainer panels are of substantially the same length as the shoulder panels but substantially wider than the shoulder panels and lie in substantially laminar relation to the shoulder panels, the opposite end portions of the retainer panels being in overlapping mutually reinforcing relation.

11. A pallet device according to claim 9 wherein said retainer panels are integrally hingedly connected to the shoulder panels.

* * * * *